United States Patent [19]

Schaublin et al.

[11] Patent Number: 4,640,109

[45] Date of Patent: Feb. 3, 1987

[54] REMOVABLE LATCH HANDLE LOCKING DEVICE

[76] Inventors: John M. Schaublin, Rt. 7, Box 378; Donna S. Schaublin, Rte. 4, Box 5215, both of Russellville, Ark. 72801

[21] Appl. No.: 618,671

[22] Filed: Jun. 8, 1984

[51] Int. Cl.[4] ..... G05G 5/00

[52] U.S. Cl. ..... 70/202; 70/211; 70/371; 70/DIG. 49

[58] Field of Search ..... 70/201, 202, 203, 207, 70/209, 210, 211, 212, 371, DIG. 49; 292/207, 218

[56] References Cited

U.S. PATENT DOCUMENTS

| | | | |
|---|---|---|---|
| 677,907 | 7/1901 | Vandeleur . | |
| 1,719,272 | 7/1929 | Lee . | |
| 1,970,485 | 8/1934 | Bins | 292/296 |
| 2,159,895 | 5/1939 | Hennicke | 70/201 |
| 2,597,583 | 5/1952 | Holmsten | 70/89 |
| 3,151,898 | 10/1964 | Olander | 70/203 |
| 3,500,668 | 3/1970 | Henry | 70/203 |
| 4,003,227 | 1/1977 | Casey | 70/14 |
| 4,082,330 | 4/1978 | McWhorter | 292/218 |
| 4,196,602 | 4/1980 | Aksdsen | 70/202 |

FOREIGN PATENT DOCUMENTS

| | | | |
|---|---|---|---|
| 346351 | 1/1921 | Fed. Rep. of Germany . | |
| 2364318 | 4/1978 | France | 70/371 |

OTHER PUBLICATIONS

"Security Key Lock", W. A. Kasyan, Oct. 1973, Technical Digest, No. 32, Western Electric, p. 25.

*Primary Examiner*—Robert L. Wolfe
*Attorney, Agent, or Firm*—James S. Waldron

[57] ABSTRACT

A removable locking device for securing latch handles for the cargo doors of trucks, trailers, rail cars and the like against unauthorized access, comprising a slide box member permanently mounted to the exterior of the door, a removable slide member, a latch handle retaining means, and a cylinder lock.

5 Claims, 18 Drawing Figures

REMOVABLE LATCH HANDLE LOCKING DEVICE

FIELD OF THE INVENTION

This invention relates to locking devices of the type employing a cylinder lock, and relates particularly to a locking device for securing the cargo doors of trucks, trailers, rail cars and the like against unauthorized access.

BACKGROUND OF THE INVENTION

Door securing or latching means for truck and trailer cargo doors are typically of two types. In one type, commonly used with swinging-type doors, a rod having latch lugs at its ends is mounted on a door and when the door is to be secured, the rod is rotated by a latch handle means attached thereto, so as to cause the latch lugs to engage corresponding catches on the truck or trailer body. In another type, commonly used with roll-up doors, a pivoted latch handle mounted near the bottom of the door has a latch hook opposite its handle portion. When this type of door is to be secured, the latch handle is rotated about its pivot so as to cause the latch hook to engage a catch carried in the truck or trailer body. In both types of closures, the latching action employed is commonly overcenter, and the door will remain latched until the latch handle is manually moved to an unlatching position.

In order to prevent unauthorized access to the cargo area, the door latch may typically be provided with means for securing the latch handle to prevent its movement to an unlatching position. Commonly utilized latch handle securing means may typically include a staple tab or ear on the latch handle which aligns with a corresponding stable tab mounted on the door when the latch handle is in a latched position, so that the shackle of a padlock may be passed through the aligned staple tabs to secure the latch handle in its latching position. In another approach, utilized for double swinging-door trailers, staple tabs are mounted to the latch rod of each door, so that when the doors are latched, the staple tabs on each door's latch rod are brought into adjacent alignment permitting a padlock shackle to be passed therethrough to prevent the rods being rotated to an unlatching position.

Such door latch securing means have a number of disadvantages. The staple tabs are typically neither robustly mounted nor of robust construction. The latch handle, being a lever, provides a means for an unauthorized user to apply considerable force upon the latch using the latch handle as a means of grasping or permitting the application of tools to break the staple tab. It is well known, for example, to slip a pipe over the end of a latch handle to obtain great leverage and thereby, to apply so much force that the staple tabs may be broken off. Alternatively, a prybar may be used to pry a staple tab loose from its mounting, or a chisel may be used to cut a staple tab off.

The padlock used to secure the door latch is also vulnerable to tampering. It is well known, for example, to use bolt cutting tools, saws and even cutting torches to cut through the shackle of a padlock, thus permitting its removal.

Freight shipments of goods and equipment may often be valued in millions of dollars and it thus becomes desirable to provide means for effectively securing cargo compartments against unauthorized access which overcome the disadvantages of known locking means and which resist attempted tampering.

SUMMARY OF THE INVENTION

The present invention overcomes the disadvantages of known door latch securing devices as used on the cargo compartment doors of trucks, trailers, and the like, by providing a locking device which is highly resistant to being opened by force, yet which may be easily and inexpensively installed to provide secured access to the cargo compartment. The locking device of the present invention comprises only three main components, and is usable with both swinging and roll-up type cargo doors.

The locking device disclosed makes use of a conventional cylinder or barrel type lock as the locking element. In use, this cylinder lock is mounted within a massive protective structure, the two component members of which cooperate to securely retain the door latch handle in a latched position.

A conventional cylinder lock of the type used with the present invention is comprised of a generally cylindrical body with a front, or outer, rim of enlarged diameter at one end of the body. A cam lug is pivotally mounted at the end of the lock body opposite its rim end. A lock cylinder, typically of the pin-tumbler type, is rotatably mounted within the lock such that by inserting a corresponding key into the lock cylinder to displace the tumbler pins, the lock cylinder may be manually rotated, with the key, to cause the cam lug to pivot inwardly or outwardly of the lock body perpendicularly cylindrical axis thereof.

The present invention comprises, in part, a stationary slide box member which is permanently and securely mounted to the exterior surface of the cargo door or the cargo compartment adjacent the door opening. The slide box member is provided with an axial slideway in which a slide member is slidable. The slide member is provided, proximate one of its ends, with latch handle retaining means for engaging the end portion of a cargo door latch handle therein.

The outer face of the slide box member is provided with an aperture therethrough communicating with the interior of the axial slideway. This aperture is so sized as to be only greater than the enlarged diameter of the front rim of the cylinder lock.

The slide member is provided mediately its ends with a through-bore having a depth slightly greater than the length of the lock body. This through bore is so sized as to be smaller in diameter than the front rim of the cylinder lock, and thus also smaller than the aperture in the outer face of the slide box member, while being only slightly greater in diameter than the lock body. A stop recess is provided in the slide member proximate the distal end of the through-bore perpendicular to the axis thereof, such that the depth of the through bore, from the front face of the slide means to the inner face of the stop recess in the opposing face, is equal to the length of the lock body, and the depth of the stop recess corresponds to the thickness of the cylinder lock's cam lug. The stop recess is configured so as to permit the cam lug to be pivoted thereinto so as to engage the inner face thereof.

The aperture through the outer face of the slide box member, and the through-bore in the slide member, are each located in their respective members such that when the slide member is fully engaged axially within the slideway of the slide box member, the aperture and the through-bore are aligned concentrically. This concentric alignment permits the cylinder lock, when its cam lug is pivoted inwardly of the lock body, to be inserted through the aperture and into the through-bore until the shoulder of the cylinder lock's front rim abuts the slide member front face proximate the through-bore. When so inserted, the aperture provides a protective bolster about the periphery of the lock's front rim. By actuating the lock cylinder, the cam lug may be pivoted outwardly of the lock body and into engagement with the stop recess in the slide member, thus securing the cylinder lock in the slide member and securing the slide member against axial movement within the slideway of the slide box member.

The latch handle retaining means extends perpendicularly outward from the slide member so as to extend perpendicularly and outwardly of the slide box member's slideway axis when the slide member is engaged therein. The latch handle retaining means is provided with an interior slideway having an axis parallel with the axis of sliding of the slide member.

The slide box member is mounted to the exterior of the cargo door, or the cargo compartment adjacent the door opening, and with its slideway axis in parallel spaced relation with the long axis of the door latch handle, proximate the end portion thereof, when in a fully latched position. The slide member is slidably outwardly within the slideway of the slide box member to bring the axis of the latch handle retaining means slideway into alignment with the long axis of the door latch handle in the fully latched position, proximate the end thereof. Sliding the slide member inwardly into fully inserted engagement within the slideway of the slide box member simultaneously brings the handle retaining means into engagement with the end portion of the door latch handle, so that the door latch handle is retained at its end within the slideway of the latch handle retaining means, while at the same time bringing the through-bore in the slide member into concentric alignment with the aperture in the outer face of the slide box member. Thus, by inserting the cylinder lock through the slide box member's aperture and into the aligned through-bore in the slide member, and then actuating the cylinder lock to pivot the cam lug outwardly of the lock body and into engagement with the inner face of the stop recess in the slide member, the slide member's latch handle retaining means are secured in retaining engagement with the door latch handle to prevent the handle from being moved into an unlatching position. Actuating the cylinder lock to pivot the cam lug inwardly of the lock body and out of engagement with the slide member stop recess permits the cylinder lock to be withdrawn from the through-bore, whereupon the slide member may be slid outwardly in the slideway of the slide box member to bring the door latch handle out of retained engagement with the latch handle retaining means, thus permitting the handle to be moved into an unlatching position.

In another embodiment of the present locking device, a pair of slide box members are provided, either or both of which may have an aperture provided in the outer face thereof as previously described. In this embodiment, these slide box members may be mounted in adjacent locations, either to a cargo door and to the truck body adjacent the cargo door opening, or, in the case of center-opening double swinging cargo doors, to the outer portions of the cargo doors, so that the respective axial slideways in both slide box members are in adjacent and aligned relation when the cargo door(s) is closed. In this embodiment, a slide member, provided with one or two through-bores in the manner previously described, is slidable within the aligned axial slideways of the two slide box members when the cargo door(s) is closed and serves to secure the door(s) in a closed position in the manner of a draw bolt. In similar manner to that previously described, when the slide member is engaged fully within the aligned axial slideways in the slide box members, the aperture(s) in the outer face of the slide box member(s) and the through-bore(s) in the slide member are aligned concentrically so as to permit the insertion of a cylinder lock(s) thereinto the slide member in the slide box members. In this embodiment, the door latch handle retaining means of the previously described embodiment is dispensed with and the slide member and slide box members act directly to secure the door(s) in a closed position.

In another embodiment of the present locking device having particularly advantageous application in the securing of roll-up type cargo doors, a slide box member as previously described may be mounted to the lower portion of the roll-up cargo door proximate a lateral edge thereof, with the axial slideway of the slide box member horizontally aligned. Mortised slide member engaging means are provided in the inner side wall of the truck body adjacent the cargo door opening and in aligned relation with the axial slideway of the mounted slide box member when the cargo door is in a lowered closed position. In this embodiment, a slide member, sans latch handle retaining means, and provided with a through-bore as previously described, is slidable within the axial slideway of the slide box member and, when the cargo door is in a lowered closed position, the slide member may be slid fully into the slide box member and, furthermore, into the aligned mortised slide member engaging means of the truck body side wall, whereupon the through-bore in the slide member is brought into concentric alignment with the aperture in the slide box member, as previously described, permitting the cylinder lock to be inserted and engaged in the locking device to secure the cargo door in a closed position.

Means are provided for easily and securely mounting the slide box member to the cargo door or cargo compartment. Means for activating an alarm circuit to indicate tampering may also be incorporated in the locking device disclosed. In another embodiment, means are disclosed for rendering the locking device even more resistant to tampering.

It is therefore an object of the present invention to provide a locking device, for securing the doors of trucks, trailers, rail cars and the like, which is resistant to tampering.

It is another object of the present invention to provide a tamper-resistant locking device for securing the doors of trucks, trailers, rail cars and the like, which is of simple and inexpensive construction.

It is still another object of the present invention to provide a tamper-resistant locking device for securing the doors of trucks, trailers, rail cars and the like, which is simple to use.

It is a further object of the present invention to provide a tamper-resistant locking device for securing the doors of trucks, trailers, rail cars and the like, which may be used with both swing type and roll-up type doors.

It is still further an object of the present invention to provide a tamper-resistant locking device for securing the doors of trucks, trailers, rail cars and the like, which includes means for activating an alarm circuit in case the locking device is tampered with.

For a better understanding of the invention, reference may be had to the following detailed description and the accompanying drawings.

DETAILED DESCRIPTION OF THE PREFERRED EMBODIMENT

In the following detailed description, the term "truck" refers to any truck, trailer, semi-trailer, rail car and the like having an enclosed cargo or freight compartment equipped with doors for access thereinto.

Figure 1A:
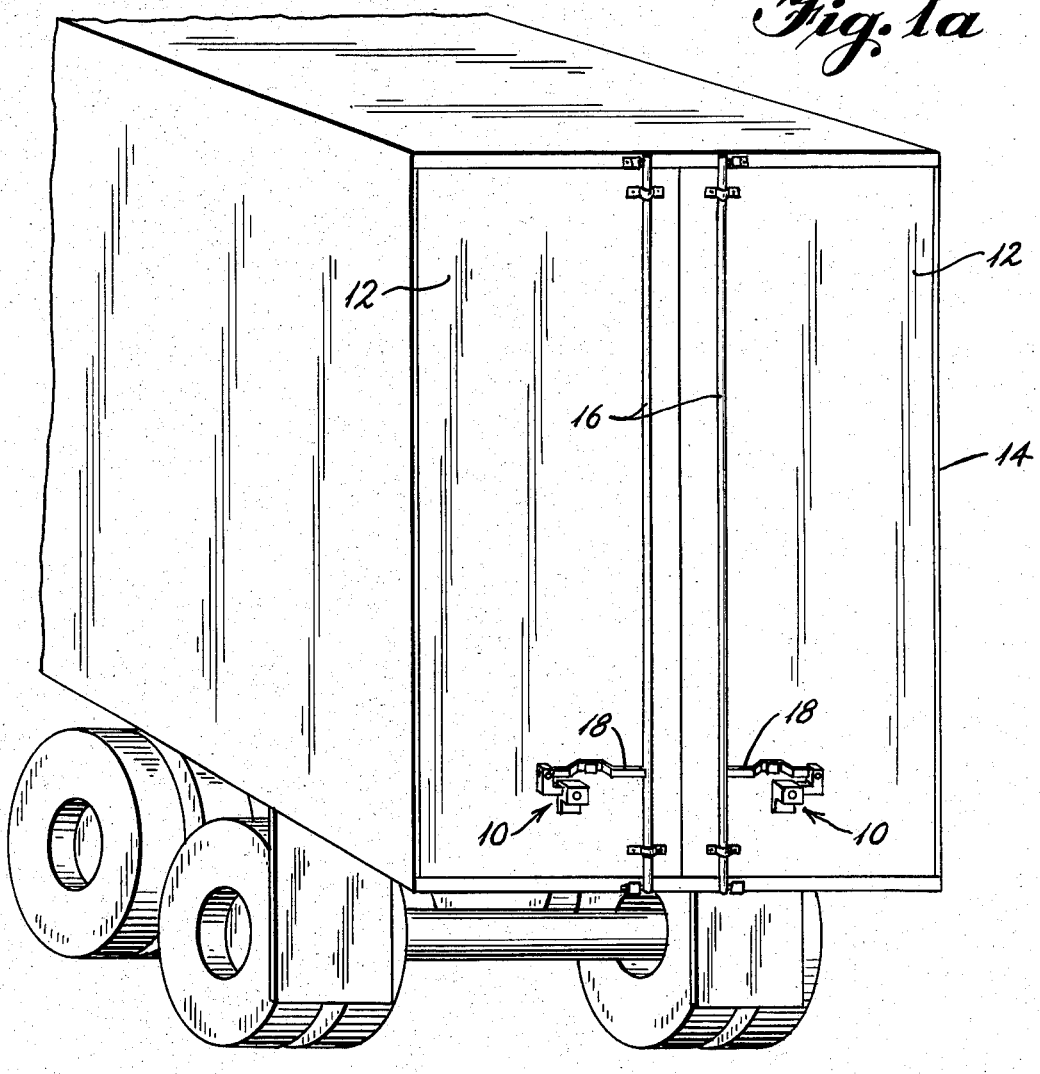
FIGS. 1*a* and 1*b* are perspective views showing the locking device of the present invention in use securing swing type cargo doors.

Referring now to the accompanying drawings, in which like reference numerals designate like elements among the several figures. In FIG. 1*a*, there are shown two of the locking devices of the present invention, indicated generally at 10, installed on the center-opening swinging cargo doors 12 of a truck 14.

Swinging-type cargo doors 12 are typically provided with latch rods 16 at the ends of which are carried latch lugs (not shown). When doors 12 are closed, latch rods 16 may be rotated by means of door latch handles 18 integral therewith to bring the latch lugs into latching engagement with corresponding catches (not shown) carried on the body of truck 14. In this latched condition, latch handles 18 extend generally parallel to the exterior surfaces of doors 12.

Figure 2A:
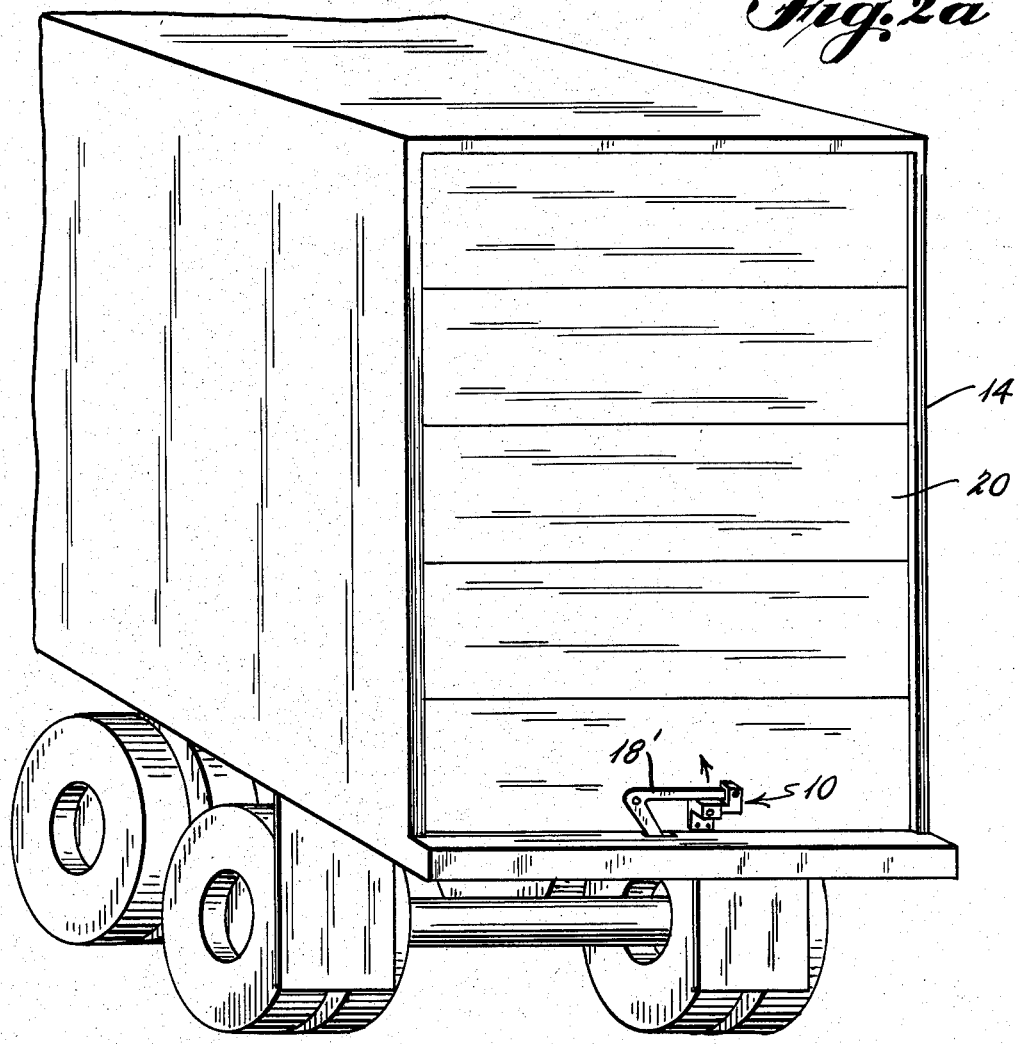
FIGS. 2*a* and 2*b* are perspective views showing the locking device of the present invention in use securing a roll-up type cargo door.

In FIG. 2*a*, there is shown a locking device 10 installed on the roll-up cargo door 20 of a truck 14. On this type of cargo door, a pivoted door latch handle 18' is pivotally mounted to the bottom edge of door 20 and is provided with a latch hook (not shown) opposite its pivoted handle 18'. When door 20 is in a rolled-down, closed position, latch handle 18' may be pivoted downwardly to bring the latch hook into latching engagement with a corresponding latch catch carried in the body of truck 14. In this latched condition, latch handle 18' extends parallel to both the exterior surface and bottom edge of door 20.

In both types of cargo door closure arrangements described, the latching action employed is commonly overcenter so that once latched, the cargo door will remain closed until the latch handle 18 or 18' is manually moved to an unlatching position. In the case of swinging door 12, latch handle 18 must be moved outwardly from its parallel position with respect to door 12 in order to rotate latch rod 16 to disengage the latch lugs from the catches so that door 12 may be opened. In the case of roll-up door 20, latch handle 18' must be rotated upwardly about its pivot to disengage the latch hook from the catch so that door 20 may be opened, in which unlatched condition handle 18' no longer extends parallel to the bottom edge of door 20.

In use, the locking device 10 of the present invention may be installed on a cargo door, or, in cases where the door latch handle extends outwardly of the cargo door opening, the locking device 10 may be installed on the truck body adjacent the door opening. The locking device 10 of the present invention is operable to secure the cargo door of a truck in a closed and latched condition by preventing the door latch handle from being moved to an unlatching position.

Figure 3:
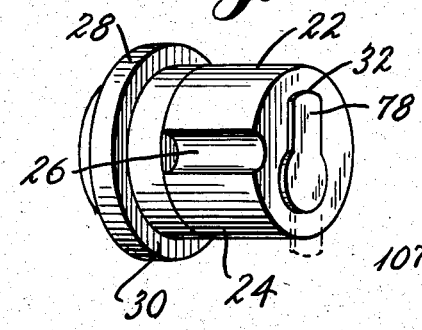
FIG. 3 is a perspective view showing a cylinder lock of the type used with the locking device of the present invention.

Referring now to FIG. 3, there is shown a conventional cylinder lock 22 of the type used with the locking device 10 of the present invention. Lock 22 is comprised of a generally cylindrical body 24, having an axial indexing groove 26 extending along its periphery. An annular rim 28, having a diameter greater than that of body 24, is provided at one end of body 24 and defines an annular shoulder 30. At the opposite end of body 24, a cam lug 32 is pivotally mounted. A lock cylinder (not shown), typically of the pin-tumbler type, is rotatably mounted within lock 22, and by inserting a corresponding key (not shown) into the lock cylinder so as to displace the tumbler pins, the lock cylinder may be manually rotated with the key to cause cam lug 32 to pivot inwardly or outwardly of body 24 perpendicularly to the axis thereof as indicated by the phantom lines. Commercially available cylinder locks suitable for use with the present invention are manufactured by Oy Wartsila AB of Helsinki, Finland, and marketed under the ABLOY brand name.

Figure 4:
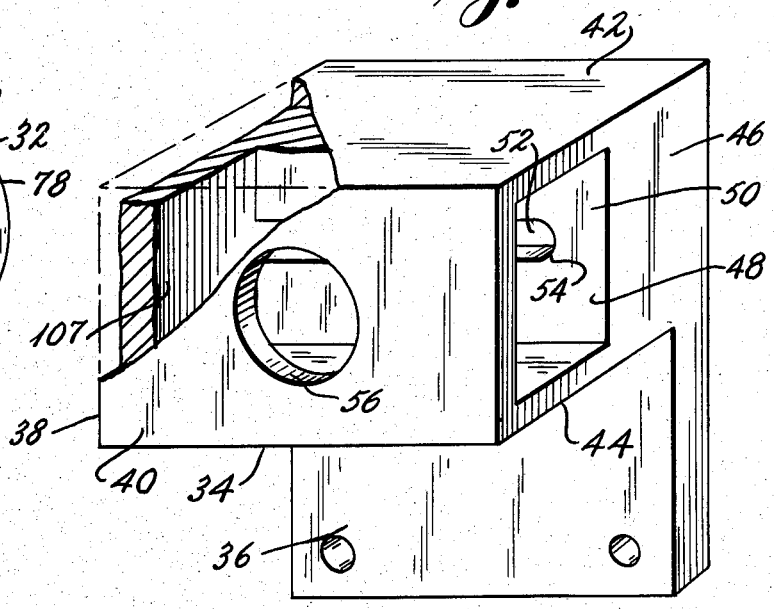
FIG. 4 is a perspective view, partly broken away, showing the slide box means of the present invention.

In FIG. 4, there is shown the stationary slide box 34 of the present invention. Slide box 34 may be mounted securely to the exterior of a cargo door or truck body as will be fully described later. Slide box 34 is provided with a plate-like base 36. Box 38 extends outwardly from base 36 and has a plate-like front face 40 in spaced parallel relation with the plate of base 36. Plate-like top face 42 and bottom face 44 extend in spaced parallel relation between base 36 and front face 40 to define box 38 therebetween. A plate-like spacer 46 extends outwardly from base 36 and has an inner face 48 in spaced relation with front face 40. Spacer 46, front face 40 and top and bottom faces 42 and 44, thus define a first horizontal slideway 50 interiorly of box 38 having an axis parallel to base 36. A groove 52 extends horizontally across inner face 48 inwardly therefrom into spacer 46 and may be provided with a closed end 54.

A circular aperture 56, having a diameter only slightly greater than that of the periphery of rim 28 of cylinder lock 22, is centrally provided through front face 40 as to communicate with slideway 50. As thus far described, the slide box 34 may be conveniently constructed from metal plate stock, such as of steel or aluminum, by known fabrication techniques. Preferably, slide box 40 is fabricated as a weldment from steel plate stock. Spacer 46 may be a length of steel bar stock, and groove 52 may be conveniently machined in inner face 48 by known milling techniques.

Figure 5:
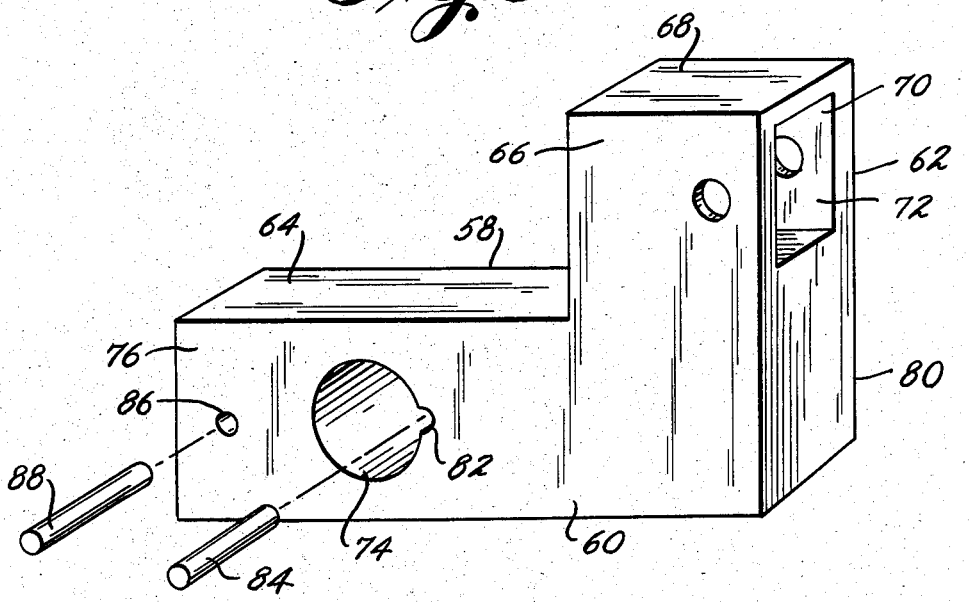
FIG. 5 is a perspective view, partly broken away, showing the slide means and latch handle retaining means of the present invention.

Referring now to FIG. 5, there is shown the L-shaped slide 58 of the present invention comprised, in part, of a generally rectangular slide bar 60 having a height and depth only slightly less than that of slideway 50 of slide box 34. Thus, slide bar 60 may be axially inserted through the open end of slideway 50 for slidable engagement therein. Slide 58 is provided with latch handle retainer 62 extending perpendicularly from the top face 64 of slide bar 60, proximate one end thereof. Latch handle retainer 62 has plate-like front, top and rear faces 66, 68 and 70, in similar manner to slide box 34, to define therewithin a second horizontal slideway 72 having an axis parallel to the long axis of slide bar 60. Slideway 72 is sized so as to permit the end portion of latch handle 18 or 18' to be slidably engaged therein, as will be more fully described below.

Slidebar 60 is provided, mediately its ends, with a first axial through-bore 74, perpendicular to front face 76 of slide bar 60 and having a diameter only slightly greater than that of body 24 of cylinder lock 22, while being also less than the peripheral diameter of rim 28. The depth of slidebar 60, as well as the axial depth of through-bore 74 therethrough, both correspond to the length of that portion of cylinder lock 22 extending from shoulder 30 to the backside 78 of cam lug 32. Thus, body 24 of cylinder lock 22 may be inserted into through-bore 74, and when fully inserted therein, such that shoulder 30 abuts front face 76 of slidebar 60, the backside 78 of cam lug 32 will lie flush with, or slightly below, the rear face 80 of slidebar 60.

As previously described, slideway 50 of slide box 34, and slidebar 60 of slide 58 are both sized such that slidebar 60 may be inserted axially into slideway 50 for slidable engagement therewith, and it will therefore be appreciated that the inward travel of slide 58 in slideway 50 will be limited by abutting contact of front and rear faces 66 and 70 of latch handle retainer 62 with top face 42 of box 38.

Through-bore 74 is located in slidebar 60 such that, when slide 58 is fully engaged within slideway 50, through-bore 74 and aperture 56 in front face 40 will be positioned in concentric alignment with one another. When slide 58 is thus fully engaged in slideway 50 as to position aperture 56 and through-bore 74 in such concentrically aligned relation, it may be appreciated that cylinder lock 22 may be inserted through aperture 56 and into through-bore 74 until shoulder 30 abuts front face 76. The wall thickness of front face 40 corresponds to the depth of rim 28 of cylinder lock 22, and thus, when cylinder lock 22 is fully inserted through aperture 56 into concentrically aligned through-bore 74, the periphery of rim 28 will be surrounded by the annular face of aperture 56, while the periphery of body 24 is surrounded by the inner surface of through-bore 74. With cylinder lock 22 thus fully inserted through aperture 56 into aligned through-bore 74, it will be further appreciated that slide 58 is prevented from travel outwardly from slide box 34, because such travel is limited by the cooperative abutting contact of body 24 and rim 28 of cylinder lock 22 with through-bore 74 and aperture 56.

An index pin bore 82 is provided in slidebar 60 peripherally of through-bore 74 and with its axis perpendicular to front face 76 thereof. An index pin 84 is insertable into index pin bore 82, which is sized to provide a press fit therewith. Index pin bore 82 is broken out along its side coincidental with the periphery of through-bore 74, so that a portion of index pin 84 protrudes interiorly into through-bore 74 along one side thereof to provide indexing means for mating with corresponding indexing groove 26 in body 24 of cylinder lock 22, and thus, rotation of cylinder lock 22 in through-bore 74 is prevented.

A retainer pin bore 86 is provided through slidebar 60 proximate its end distal to latch handle retainer 62, and extends perpendicularly to front face 76 thereof. A retainer pin 88 is insertable into retainer pin bore 86, which is sized to provide a press fit therewith. Retainer pin bore 86 is so located in slidebar 60 as to align with groove 52 in inner face 48 of spacer 46 when slide 58 is engaged in slideway 50 of slide box 34. Thus, slide 58 may be inserted into slideway 50 until retainer pin bore 86 is accessible through aperture 56, and retainer pin 88 may then be drivably inserted in retainer pin bore 86 so as to protrude rearwardly of rear face 80 of slidebar 60 and into slidable engagement with groove 52. In this way, the outward travel of slidebar 60 in slideway 50 is limited by engagement of retainer pin 88 with closed end 54 of groove 52, so that slide 58 is thus retained in slidable engagement at all times in slide box 34.

Referring now to FIGS. 6, 7, 8 and 9, a stop recess 90 is provided inwardly of the rear face 80 of slidebar 60 and extending perpendicularly to the axis of through-bore 74 so as to communicate therewith. Stop recess 90 is provided with an inner face 92 spaced inwardly of rear face 80. The depth of stop recess 90 inwardly of rear face 80 corresponds to the thickness of cam lug 32 of cylinder lock 22, that is, the distance from the rear face of body 24 to the back side 78 of cam lug 32. The width of stop recess 90 corresponds to the diameter of through-bore 74.

Figure 8:
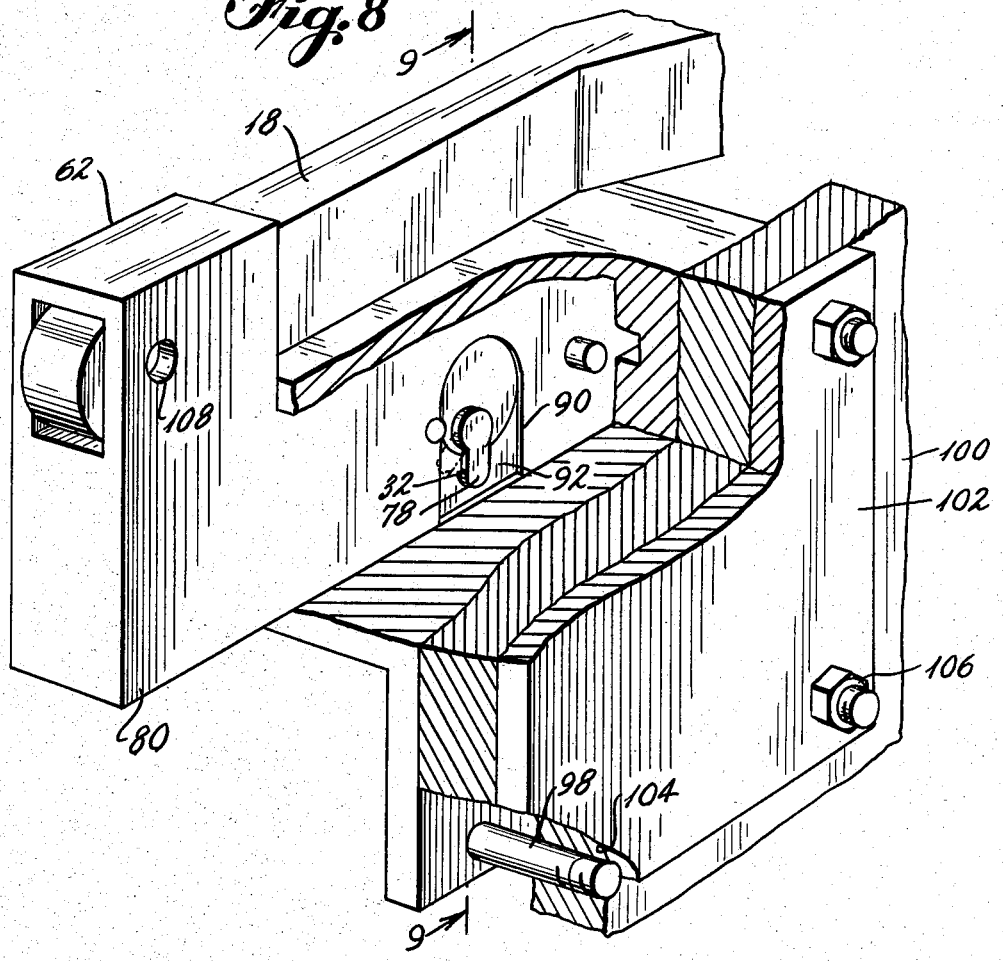
FIG. 8 is a perspective view, partly broken away, showing the locking device of the present invention in a locked condition and in retaining engagement with a door latch handle.

It may be appreciated that, with slide 58 fully engaged within slideway 50 of slide box 34 and with cylinder lock 22 fully inserted into through-bore 74, as shown in FIG. 8, the lock cylinder may be turned with a key so as to pivot cam lug 32, shown in phantom lines, outwardly of body 24 and into engagement with inner face 92 of stop recess 90, thus preventing the withdrawal of cylinder lock 22 from slide 58, while also preventing the outward travel of slide 58 from slide box 34 as described above.

Base 36 of slide box 34 is provided, at its rear face 94, with a plurality of mounting studs 96 extending perpendicularly therefrom and threaded at their outer bends.

Slide box 34 may thus be mounted to the exterior surface of a cargo door panel, as of swinging door 12 or roll-up door 14, or to the exterior surface of the cargo compartment of a truck adjacent the door opening therein, by inserting mounting studs 96 through corresponding mounting holes 98 passing through panel 100 of a cargo door or compartment. A backing plate 102 also having through-holes 104 located therein at positions corresponding to mounting studs 96 may be placed against the interior surface of panel 100 upon mounting studs 96 and fastened rigidly thereto with mounting nuts 106. When thusly mounted to panel 100, slide box 34 may not be removed from panel 100 except by access to its interior side, which access, it will be appreciated, is prevented when the truck cargo doors are closed. Backing plate 102 is preferrably of a size corresponding to base 36 or larger, so as to resist any attempted prying of slide box 34 from panel 100. Where it is desired to incorporate locking device 10 in a new truck, slide box 34 may be set into panel 100 during the manufacturing stage so that base 36 is flush with the exterior of panel 100 in order to make base 36 less accessible to prying tools and the like.

Figure 6:
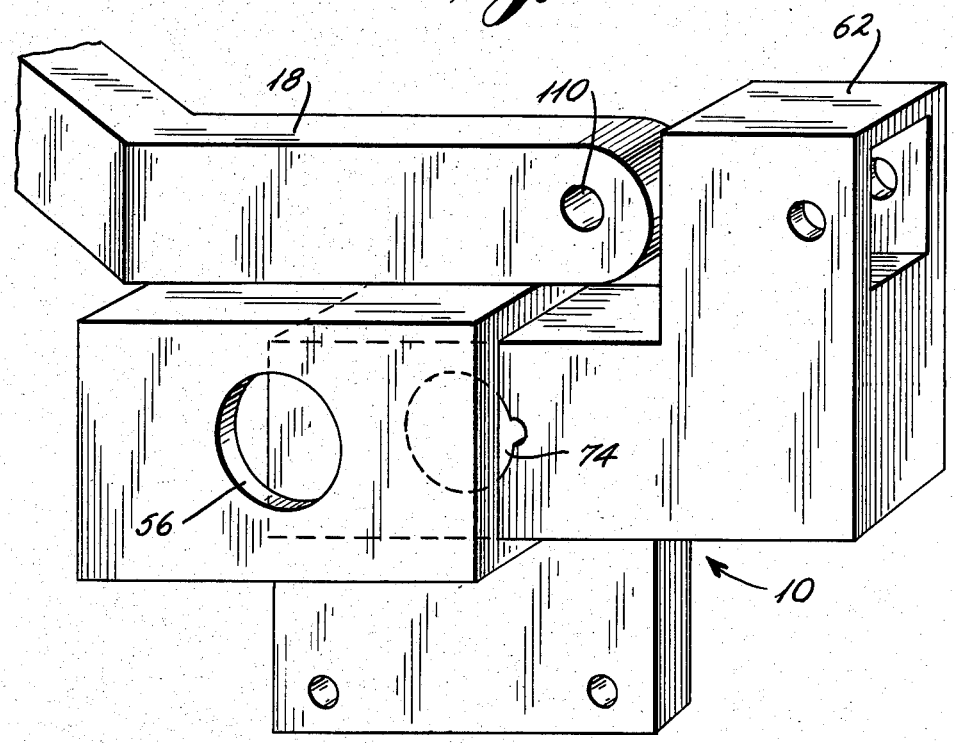
FIG. 6 is a perspective view showing the locking device of the present invention and a door latch handle, with the locking device in an unlocked condition.
Figure 7:
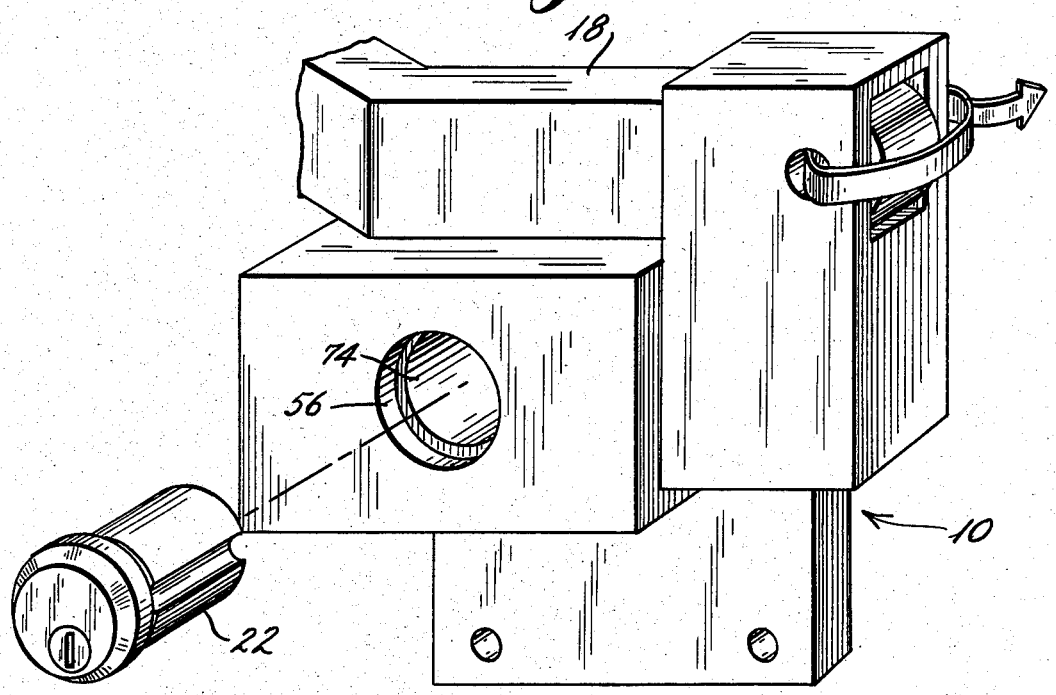
FIG. 7 is a perspective view showing the locking device of the present invention in a lockable condition and in retaining engagement with a door latch handle.

Accordingly, locking device 10 is mounted on truck 14 in a position such that, with slide 58 fully extended outwardly from slide box 34, latch handle retainer 62 is located proximately the end of door latch handle 18 or 18' when door 12 or 14 is latched, as shown in FIG. 6. In this position, the axis of slideway 72 in latch handle retainer 62 is aligned with latch handle 18 or 18', and when slide 58 is inserted fully inwardly into slide box 34, the end portion of latch handle 18 or 18' is brought into fully enclosed engagement within latch handle retainer 62, as shown in FIGS. 7 and 8. As previously described, when slide 58 is thusly fully engaged within slide box 34, cylinder lock 22 may be inserted through aperture 56 and into through-bore 74, whereupon cam lug 32 may be pivoted into engagement with stop recess 90. In this manner, outward extension of slide 58 from slide box 34 is prevented, and latch handle 18, being engaged within latch handle retainer 62, is prevented from being moved into an unlatching position.

In order to make locking device 10 even more resistant to tampering, an end plate 107 may be provided to enclose the end of slideway 50, opposite the end into which slide 58 is inserted, thus preventing the application of a blow to slidebar 60. It will be appreciated that cam lug 32, when engaged in stop recess 90, is not susceptible to axial forces applied to slidebar 60, because of the protective enclosure afforded by the side walls of stop recess 90.

Latch handle retainer 62 may be provided with holes 108 through front and rear faces 66 and 70, which correspond to a similar hole 110 provided proximate the end of latch handle 18, so that with latch handle 18 engaged within latch handle retainer 62, a seal tag may be fastened through holes 108 and 110, as shown in FIG. 7.

Figure 9:
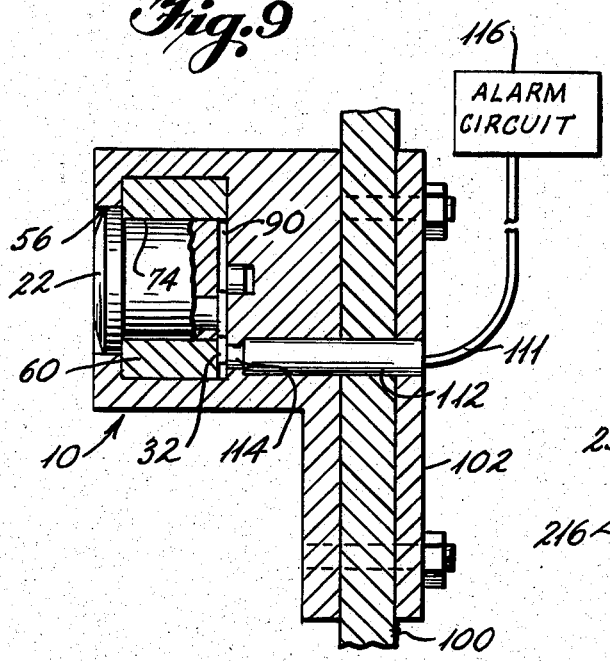
FIG. 9 is a sectional view showing the locking device of the present invention, taken along line 9—9 of FIG. 8.

As shown in FIG. 9, alarm circuit activating means 111 may be incorporated in locking device 10, as by mounting a plunger-type switch 112 in aligned mounting holes provided through backing plate 102, panel 100, base 36 and spacer 46. Switch 112 is preferrably mounted so that plunger 114 is normally urged outwardly slightly into slideway 50 and is displaced inwardly into switch 112 by slidebar 60 when slide 58 is engaged fully within slide box 34. In this manner, alarm circuit 116 may be activated when slide 58 is moved outwardly from slide box 34 to disengage latch handle 18 from latch handle retainer 62, thus indicating that latch handle 18 is no longer secured by locking device 10. It will be appreciated that switch 112 may alternatively be mounted in a location where plunger 114 is displaceable by cam lug 32 of cylinder lock 22, in order to indicate that locking device 10 is in either a locked or unlocked condition. Furthermore, plunger 114 will preferrably have a ball or spherical tip which will engage a corresponding shallow depression or detent formed in the displacing member (i.e., rear face 80 of slidebar 60 or back side 78 of cam lug 32) so as to prevent alarm circuit activating means 100 being defeated by the interposition of a thin strip between inner face 48 of spacer 46 and rear face 80 of slidebar 60.

Figure 1B:
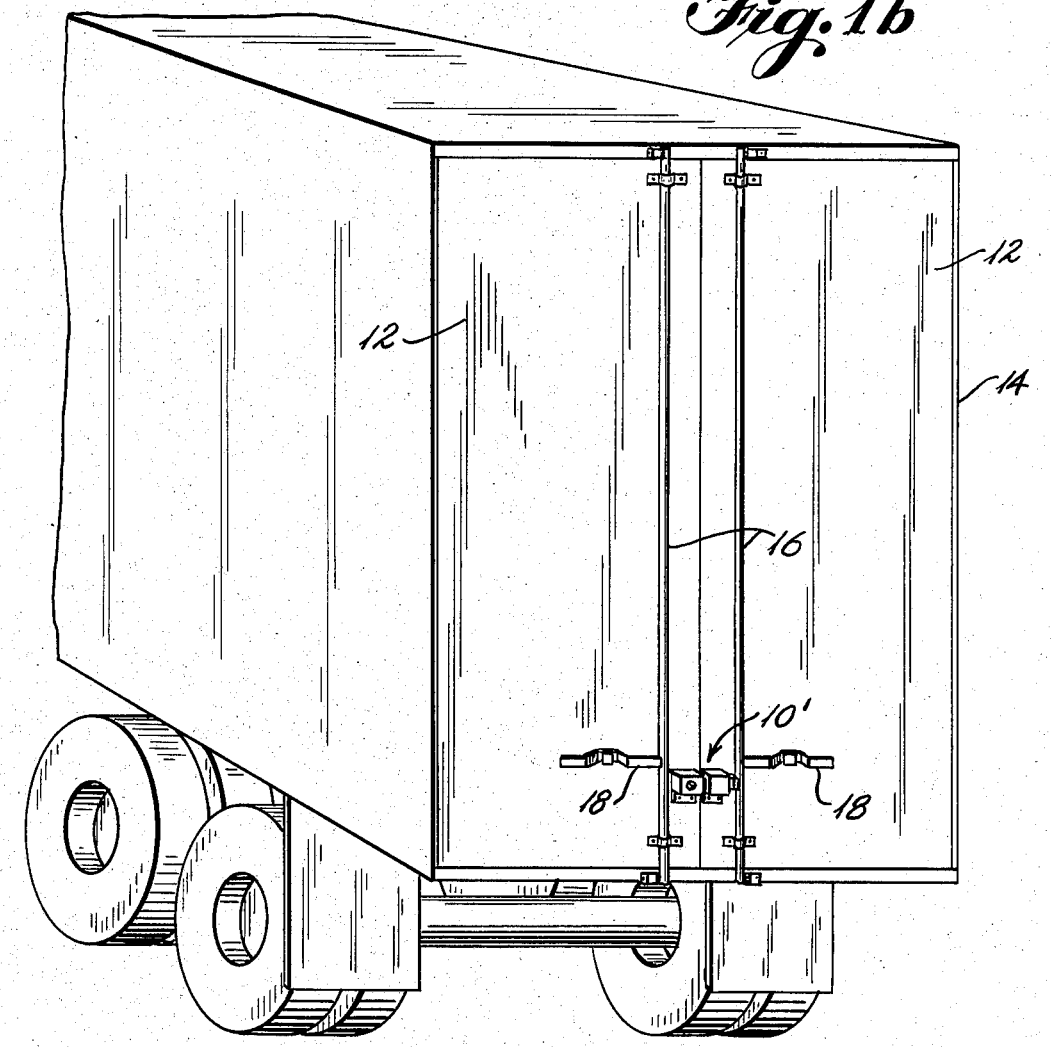
Figure 10:
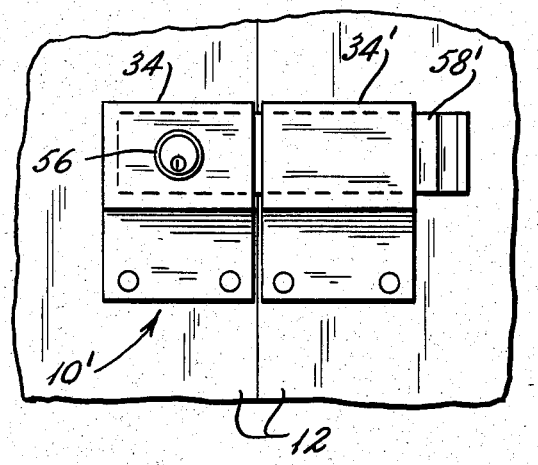
FIG. 10 is a view in frontal elevation of an alternative embodiment of the locking device of the present invention as shown in FIG. 1*b*.

Referring now to FIG. 1*b*, there is shown another embodiment of the locking device of the present invention, indicated generally at 10', in use securing the center-opening swinging cargo doors 12 of truck 14. As shown in FIG. 10, locking device 10' is comprised of a pair of slide boxes 34 and 34' and slide 58'.

Slide boxes 34 and 34' may be mounted to doors 12, as previously described, in adjacent locations on the outer portions of doors 12 so that, when doors 12 are closed, their respective axial slideways 50 will be in adjacent aligned relation. As shown, slide box 34 is provided with an aperture 56 in its front face 40, as previously described, while slide box 34' has no aperture in its front face 40'.

Figure 11:
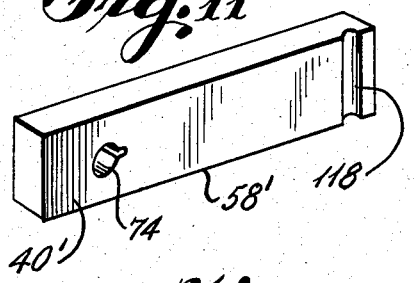
FIG. 11 is a perspective view showing the slide means of the locking device shown in FIG. 10.

Slide 58', shown in FIG. 11, is a rectangular bar, similar to slidebar 60 of previously described slide 58, but differing therefrom by virtue of its being greater in length than the latter and also by the absence of latch handle retainer 62. Slide 58' is provided with a through-bore 74, index pin bore 82 with index pin 84, and stop recess 90 in similar manner as slide 58, and may be further provided with a groove 118 in its front face 76' proximate its end distal from through-bore 74. Groove 118 may typically be semi-circular in profile and extend substantially across face 76' so as to serve as a means for grasping slide 58' in order to slide it within slideways 50 or slide boxes 34 and 34'. Through-bore 74 is located in slide 58' such that, when slide 58' is fully engaged within the aligned sideways 50 of slide boxes 34 and 34', through-bore 74 will be aligned concentrically with aperture 56 to permit cylinder lock 22 to be inserted thereinto as previously described. It will be appreciated that when slide 58' is fully engaged within slide boxes 34 and 34', and secured therein with cylinder lock 22, then doors 12 will be thereby secured in a closed position, in the manner of a draw bolt, regardless of the positions of latch handles 18.

Figure 12:
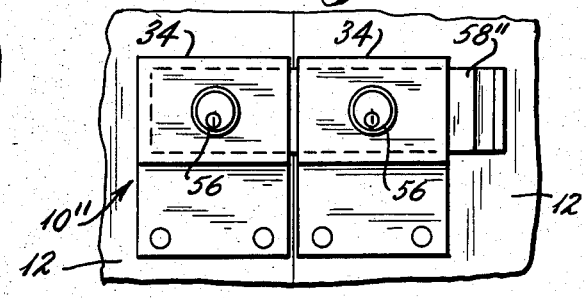
FIG. 12 is a view in frontal elevation of another embodiment of the locking device shown in FIG. 10.
Figure 13:
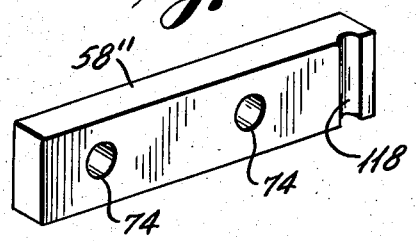
FIG. 13 is a perspective view showing the slide means of the locking device shown in FIG. 12.

As shown in FIG. 12, a locking device 10'', comprised in part of slide boxes 34, both provided with apertures 56, may be similarly mounted on doors 12, in which case a slide 58'' (having a corresponding pair of through-bores 74, index pin bores 82 with index pins 84, and stop recesses 90) is provided, as shown in FIG. 13, for slidable engagement therein. Slide 58'' is also provided with a groove 118 in similar manner to slide 58'. Through-bores 74 are located in slide 58'' such that, when slide 58'' is fully engaged within the aligned slideways 50 of slide boxes 34, through-bores 74 will be aligned concentrically with apertures 56 to permit a pair of cylinder locks 22 to be inserted thereinto as previously described. And, as will be further appreciated, when slide 58'' is fully engaged within slide boxes 34 and secured therein with a pair of cylinder locks 22, then locking device 10'' will secure doors 12 in a closed position, in the manner of a draw bolt, regardless of the positions of latch handles 18.

It will also be appreciated that in the case where it is desired to secure a single swinging door 12, this may be accomplished simply by mounting one slide box 34 (or 34') to the door 12 proximate its swinging edge and another slide box 34 to the truck body adjacent the door opening and with its slideway 50 aligned with that of the door mounted slide box for mutual engagement by slide 58' or 58'' as may be appropriate, in the manner of a draw bolt.

Figure 2B:
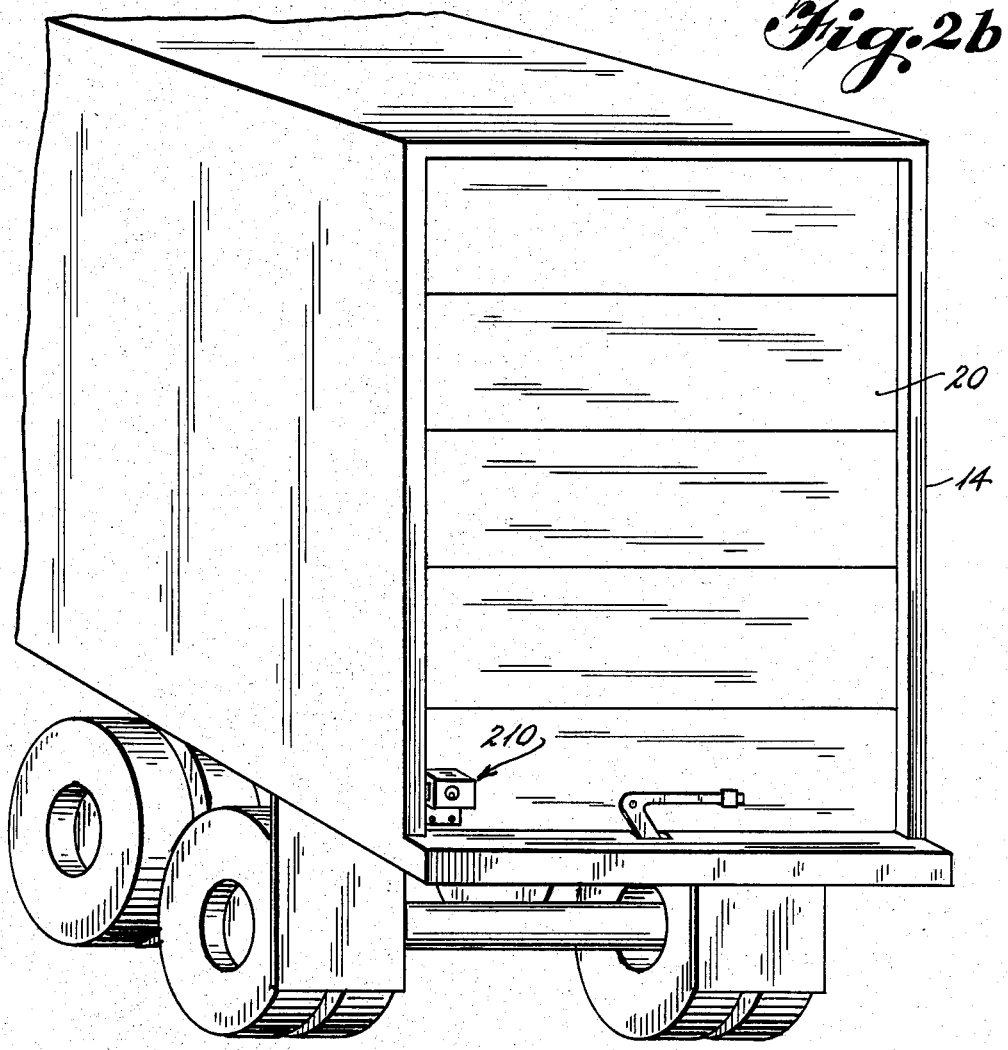

Referring now to FIG. 2*b*, there is shown another embodiment of the locking device of the present invention, indicated generally at 210, in use securing the roll-up cargo door 20 of truck 14. As further shown in FIG. 14, locking device 210 is comprised of a slide box 34, as previously described, and a slide 258.

Slide box 34 may be mounted to the lower portion of door 20 proximately the lateral (i.e., vertical) edge thereof and with its slideway horizontally aligned in parallel relation with the bottom edge of door 20, in similar manner as previously described.

Slide 258 is provided with a through-bore 74, index pin bore 82 with index pin 84, stop recess 90 and groove 118, in similar manner as previously described slide 58', and is sized for slidable engagement within axial slideway 50 of slide box 34.

Figure 14:
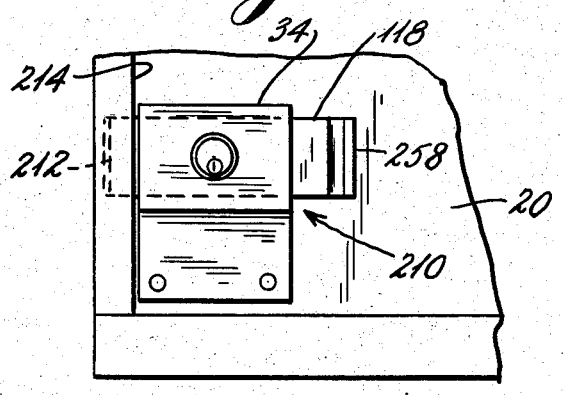
FIG. 14 is a view in frontal elevation of an alternative embodiment of the locking device of the present invention as shown in FIG. 2*b*.

A mortised recess 212, shown in phantom lines in FIG. 14, is formed in the inner side wall 214 of the door opening of truck 14 and located so as to be aligned with axial slideway 50 of mounted slide box 34 when door 20 is in a lowered closed position. Recess 212 is sized such as to permit the end of slide 258, distal from groove 118, to be engaged therein when slide 258 is fully engaged in slide box 34 and through-bore 74 is aligned concentrically with aperture 56. Recess 212 thus provides engagement means for the end portion of slide 258 such that, when slide 258 is fully engaged therein and cylinder lock 22 is engaged in locking device 210, door 20 will be secured in a closed position.

Figure 15:
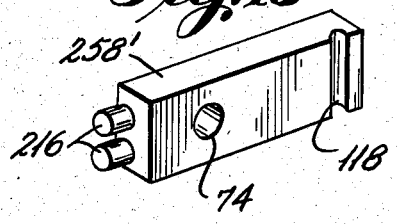
FIG. 15 is a perspective view showing the slide means of the locking device shown in FIG. 2*b*.

In certain instances, it may not be practical or desirable to form a mortised recess in inner side wall 214, and in such cases, a slide 258', shown in FIG. 15, may be utilized. Slide 258' is provided with a through-bore 74, index bore 82 with index pin 84, a stop recess 90, and a groove 118, similar to slide 258, but in contrast to the latter, slide 258', at its end distal from groove 118, is provided with one or more bolts 216. Bolts 216 may typically be comprised of lengths of round steel rod, preferably hardened, affixed into corresponding blind holes formed in the end of slide 258'.

Figure 16:
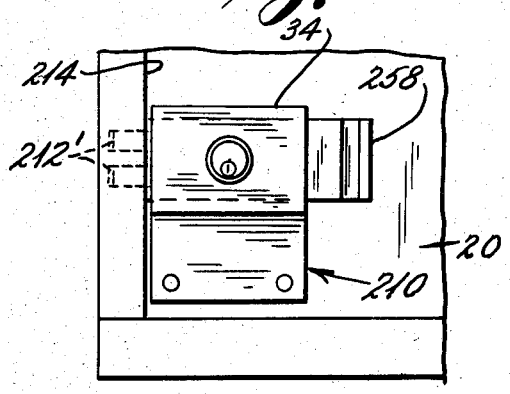
FIG. 16 is a view in frontal elevation of another embodiment of the locking device shown in FIG. 2*b*.

As shown in FIG. 16, when slide 258' is to be utilized, one or more round holes 212', shown in phantom lines, will be formed in inner side wall 214 in aligned locations with bolts 216 and will be engaged thereby in similar manner as with recess 212 and slide 258, thus securing door 20 in a closed position when a cylinder lock 22 is engaged in locking device 210 as previously described.

It will be appreciated that the locking device of the present invention may be further modified for utilization with various types of latch handles, door closures, or other movable members and that other types of locking elements may be suitably employed without departing from the scope of the invention and the appended claims.

Having now described the locking device of the present invention, what is desired to be protected by Letters Patent is:

What is claimed is:

1. In combination with a truck, trailer, rail car or the like having a cargo door with a latch and a latch handle movable between a first latched and a second unlatched position, a cylinder lock having an indexable body, a front rim having a diameter greater than that of said body, a lock cylinder and a cam lug pivotally mounted on said body opposite said front rim movable by said lock cylinder between a first receivable position inwardly of said body and a second position extending outwardly of said body, a locking device mounted to said door for engaging said latch handle when said latch handle is in its said first position and for receiving said cylinder lock when said cam lug is in its said first position, whereby said latch handle is retained in its said first position when said cam lug is moved to its said second position;

said locking device comprising:

(a) stationary slide box means having a first axial slideway;

(b) first lock receiving means in said slide box means in communication with said first axial slideway and having a diameter corresponding to that of said front rim;

(c) slide means slidable in said first axial slideway between a first and a second position;

(d) indexed second lock receiving means in said slide means alignable concentrically with said first lock receiving means in said slide box means when said slide means is in its said first position and having a diameter corresponding to that of said body;

(e) latch handle retaining means in said slide means having a second axial slideway slidably engageable over said latch handle when said latch handle is in its said first position and said slide means is in its said first position; and (f) cam lug engaging means in said slide means in communication with said second lock receiving means and engageable by said cam lug when said slide means is in its said first position, said lock is received within said first and second index lock receiving means and said cam lug is in its said second position.

2. The locking device of claim 1, wherein said first lock receiving means is a circular aperture only slightly greater in diameter than said front rim, said second lock receiving means is an indexed axial bore having a diameter only slightly greater than said body and less than said front rim, and said cam engaging means is a recess extending perpendicular to the axis of said indexed bore.

3. The locking device of claim 1, wherein said slide box means is provided with flat mounting base means having a plurality of threaded mounting studs extending therefrom, backing plate means mountable on said mounting studs, and mounting nuts for threadable engagement on said mounting studs, whereby said slide box means may be mounted to said door by placing said base against the exterior door surface with said mounting studs passing through corresponding holes provided in said door so as to protrude past the interior door surface, mounting said backing plate on said protruding mounting studs and threadably engaging said mounting nuts on said protruding mounting studs.

4. The locking device of claim 1, further comprising alarm circuit activating means for activating an alarm circuit when said slide means is moved from its said first position.

5. The locking device of claim 1, further comprising alarm circuit activating means for activating an alarm circuit when said lock is received in said first and second lock receiving means and said cam lug is moved from its said second position.

* * * * *